5/3/87 03 4,671,055

United States Patent [19]

Tschanz et al.

[11] Patent Number: 4,671,055

[45] Date of Patent: Jun. 9, 1987

[54] BRACELET FOR THE JEWELRY AND WATCH MAKING INDUSTRY

[76] Inventors: Pierre Tschanz, Neuwis 25, 8700 Küsnacht; Jean-Pierre Hagmann, 5, rue Comte-Géraud, 1213 Onex, both of Switzerland

[21] Appl. No.: 789,969

[22] PCT Filed: Feb. 11, 1985

[86] PCT No.: PCT/CH85/00023

§ 371 Date: Oct. 4, 1985

§ 102(e) Date: Oct. 4, 1985

[87] PCT Pub. No.: WO85/03417

PCT Pub. Date: Aug. 15, 1985

[30] Foreign Application Priority Data

Feb. 13, 1984 [CH] Switzerland ..... 671/84

[51] Int. Cl.[4] ..... A44C 5/02

[52] U.S. Cl. ..... 59/80; 59/82; 59/84; 63/4

[58] Field of Search ..... 59/80, 81, 82, 84, 78, 59/85; 63/4; 403/390, 167, 168, 186

[56] References Cited

U.S. PATENT DOCUMENTS

| | | | |
|---|---|---|---|
| 1,476,462 | 12/1923 | Pejchar | 59/80 |
| 1,518,745 | 12/1924 | Mehrlust | 59/80 |
| 2,584,207 | 2/1952 | Holl | 59/80 |

FOREIGN PATENT DOCUMENTS

| | | |
|---|---|---|
| 1460162 | 3/1969 | Fed. Rep. of Germany . |
| 1228216 | 8/1960 | France . |
| 2040032 | 1/1971 | France . |

*Primary Examiner*—Robert L. Spruill
*Assistant Examiner*—David B. Jones
*Attorney, Agent, or Firm*—Cushman, Darby & Cushman

[57] ABSTRACT

A bracelet for the jewelry and watch making industry, includes rectangular elements connected in a flexible manner by oval links to form several parallel rows adjacent each other. The elements of adjacent rows are also connected with each other by oval links. Each element includes an upper plate and a bottom plate having cutouts that receive the free ends of pillars protruding from the upper plate. The links are of a sufficient dimension to embrace one pillar each of adjacent elements with sufficient play in the longitudinal and transverse direction of the plate, a vertical play being assured by the height of an abutment that keeps the upper plate and the bottom plate at an appropriate distance from each other.

6 Claims, 6 Drawing Figures

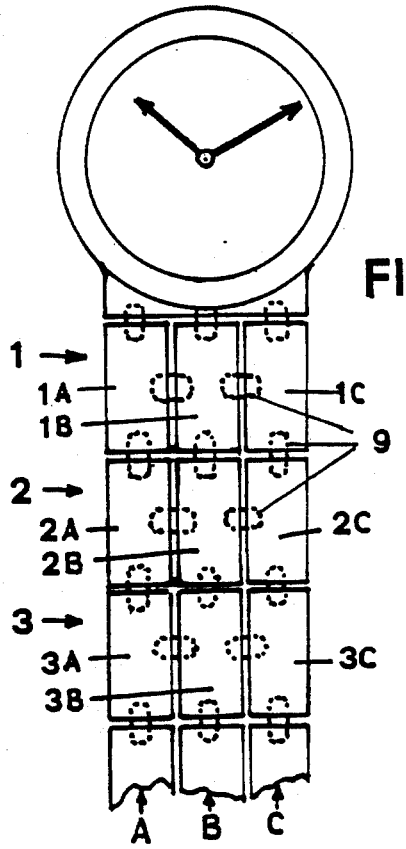
FIG.1
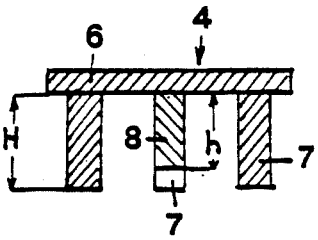
FIG.2
FIG.3
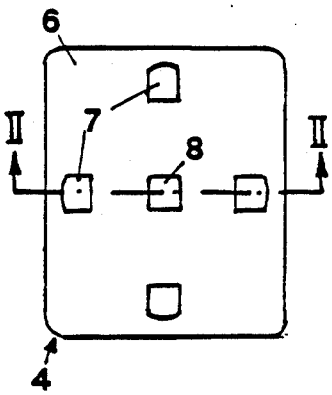
FIG. 5
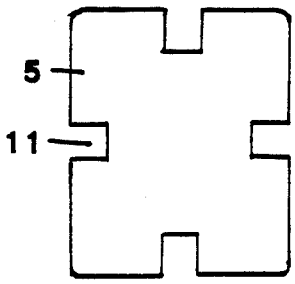
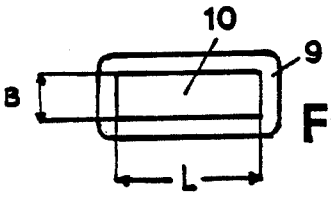
FIG. 4
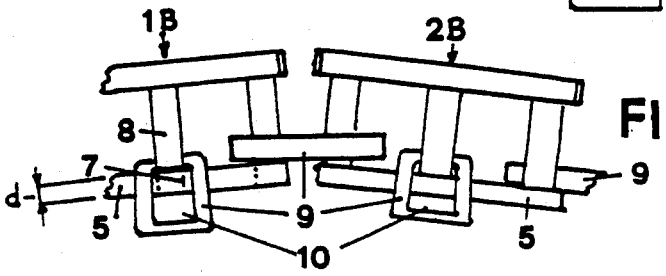
FIG. 6

BRACELET FOR THE JEWELRY AND WATCH MAKING INDUSTRY

The object of the invention is a bracelet for the jewelry and watch making industry, composed of several parallel rows of combined elements which are connected in a flexible manner by link members whereby neighboring rows are connected with each other by other link members. Bracelets of this kind are well known, and their flexibility for laying them around the wrist is sufficient.

Nevertheless, one has known up to now only bracelets on which these elements of one row were staggered, in the longitudinal direction, with regard to the neighboring row or rows. Such a staggering was necessary in order to link the ends of all elements by means of simple elements such as transverse rods or shafts which pass through all rows, from one edge of the bracelet to the other. Instead of these rods or shafts link members in form of a strip with rolled-up ends have also been used, these members having the same shape and the same dimensions as the combined elements themselves. In this manner a solid bracelet was realized which nevertheless has the flexibility of a chain, but that way of creating a bracelet was only possible with the staggering already mentioned, which not only imposed restrictions in the shape and the production of the bracelet but also necessitated so-called half-elements, i.e. elements of reduced length at the ends of the bracelet.

It is one object of the invention to overcome these deficiencies and to create a bracelet in which in all rows neighboring combined elements are disposed side by side over their entire length, thus forming not only longitudinal but also transverse rows.

It is another object of the invention to simplify manufacturing of the bracelet by providing combined elements which are made up of a minimum of parts.

A preferred embodiment of the bracelet according to the invention is illustrated in the drawings in which FIG. 1 is a partial view of a braid of the bracelet, FIG. 2 a side view of an upper element along line II—II of FIG. 3, FIG. 3 a view of the upper element from below, FIG. 4 a connecting mesh between combined elements, and FIG. 5 a view of a bottom plate FIG. 6 a side view of two combined elements of the inner row of the braid.

According to FIG. 1, the bracelet which, by means of its braids, is attached in a known and hence only schematically illustrated manner to a watch 1, is composed of several rows A, B, C etc., e.g. three rows, each row being composed of combined elements 1, 2, 3 etc. Said elements 1, 2, 3 etc. are rectangular in this embodiment and arranged in such a way that their longer edges meet themselves side by side. This arrangement differs from the prior art in which the elements of one row, e.g. those of row B, are staggered, in longitudinal direction, with regard to the elements of the neighboring rows A and B, in order to permit the rear ends of the elements of these rows and the forward ends of the row B to be linked by a rigid tranverse rod or shaft about which all elements may pivot in order to assure the necessary flexibility of the bracelet; identical rods or shafts are also provided for the forward ends of the elements in rows A, C and the rear ends of the elements of row B.

As can be seen from FIGS. 2, 3 and 5, each combined element 1, 2, 3 of longitudinal rows A, B, C is composed of only two parts, namely an upper element 4 and a bottom plate 5, which renders these combined elements very simple and easy to produce. Upper element 4 which constitutes the visible side of the bracelet (when it is worn) comprises an upper plate 6, a number of pillars 7, here four, which are vertically attached to the lower side of upper plate 6, and a central abutment 8. Pillars 7 are in this embodiment arranged in the middle of each edge of upper plate 6 and have a height H. They may have a generally square section, with one edge rounded (for reasons of manufacture) as shown, or any other suitable cross-section. Central abutment 8 which preferably has the same or a cross-section similar to the one of pillars 7, is of a height h that is reduced, compared with the height H of the pillars. The difference between these two heights preferably corresponds to the thickness d (see FIG. 6) of bottom plate 5.

The purpose of pillars 7 is to take up meshes 9 which serve as link members between elements 1, 2, 3 etc., both in the longitudinal as in the transverse sense. These meshes are generally annular; preferably they are plates in which an opening 10 is cut. This opening 10 is of sufficient length in order to house together two adjacent pillars 7 of two neighboring elements with a longitudinal play. The width of opening 10 is greater than the width of the pillars so that there is also a lateral play with regard to the respective mesh which permits a limited lateral staggering between said neighboring elements.

In order to avoid that the meshes move off the pillars 7, bottom plate 5 is provided with cutouts 11 which are of such dimensions and are arranged in such a manner along its edges that bottom plate 5 can be lodged in the free ends 12 of pillars 7 to which it is connected, mostly by soldering.

The longitudinal play between each mesh 9 and the two pillars 7 ensures to the bracelet the necessary flexibility in the longitudinal sense which in addition is assisted by the fact that base plates 5 have, at least longitudinally, dimensions that are slightly smaller than the ones of upper plate 6 of upper elements 4. The lateral play increases the general flexibility of the bracelet. Nevertheless, these two plays are not yet enough. The flexibility depends also of the fact that the meshes can take an inclined position with regard to at least one of the adjacent combined element, as can be taken from FIG. 6, and it is therefore essential that abutment 8 has a certain height so as to keep upper plate 6 and bottom plate 5 sufficiently spread apart from each other. Abutment 8 acts therefore as a spacer.

As already mentioned and as shown in FIG. 1, meshes 9 do not only serve for linking the combined elements of a longitudinal row A, B, C, but also for linking neighboring elements of two adjacent rows, and in this manner also transverse rows are obtained. For the two end rows of the braid, in this embodiment rows A and C, only three pillars 7 and three cutouts 9 could be provided in bottom plates 5 for each combined element since there are no meshes along the edges of the bracelet. However, for reasons of simplicity in manufacturing, it is of advantage to manufacture but one kind of elements 4, thus such having four pillars and four cutouts as shown.

The combined elements may. have any shape, beyond the rectangular or square one already mentioned, the final shape adopted depending form the esthetic point of view. One could therefore provide round, elliptic, rhombic, trapezoidal or generally polygonal elements, or square elements could be provided but rotated by 45 degrees from the position illustrated for the rectangular elements; the pillars must then be arranged in the corners of the square. One could even provide, if the price of the bracelet is of no primary importance, wholly irregular shapes and sizes. Such a bracelet resembles to a leather bracelet, especially a crocodile leather bracelet. However, the rectangular or square elements in their position as shown have the advantage that they hide the link members or meshes 9 in the best way, even if they do not have the same thickness.

We claim:

1. A bracelet for the jewelry and watch making industry, comprising a plurality of rectangular elements connected in a flexible manner by link members to form several parallel rows adjacent each other, the elements of adjacent rows facing each other over their entire sides and being connected with each by elements identical to those connecting the elements of the rows, the link members being closed oval rings; each element including an upper plate having a number of pillars protruding from one face of the upper plate and a central abutment of smaller height than the pillars also protruding from said face, and a bottom plate having cutouts that receive the free ends of the pillars, the bottom plate seating against the free end of the central abutment, the pillars being disposed along the edges of the upper plate, the link members being of a sufficient dimension to embrace one pillar each of adjacent elements with sufficient play in the longitudinal and transverse direction of the plate, a vertical play being assured by the height of the abutment that keeps the upper plate and the lower one at an appropriate distance from each other.

2. A bracelet as in claim 1 wherein the pillars are of a height that is larger than the height of the central abutment by a distance that equals the thickness of the bottom plate.

3. A bracelet as in claim 1 wherein the bottom plate has dimensions that are smaller, at least in the longitudinal sense of the bracelet, than the dimensions of the upper plate.

4. A bracelet as in claim 1 wherein the pillars are arranged at the middle of each edge of the upper plate of each element.

5. A bracelet as in claim 1 wherein all the elements are equipped with four pillars.

6. A bracelet as in claim 1 wherein the link members between the elements of the same row and those between the elements of neighboring rows are identical.

* * * * *